US009664008B2

(12) United States Patent
Kippola et al.

(10) Patent No.: US 9,664,008 B2
(45) Date of Patent: May 30, 2017

(54) DOWNHOLE COMPLETION TOOL

(71) Applicants: Kevin Scott Kippola, Katy, TX (US); Tracy Dean Blanton, Cypress, TX (US); Todd Ulrich Chretien, Cypress, TX (US); William John Darnell, Cypress, TX (US)

(72) Inventors: Kevin Scott Kippola, Katy, TX (US); Tracy Dean Blanton, Cypress, TX (US); Todd Ulrich Chretien, Cypress, TX (US); William John Darnell, Cypress, TX (US)

(73) Assignee: PetroQuip Energy Services, LLC, Waller, TX (US)

( * ) Notice: Subject to any disclaimer, the term of this patent is extended or adjusted under 35 U.S.C. 154(b) by 735 days.

(21) Appl. No.: 14/098,012

(22) Filed: Dec. 5, 2013

(65) Prior Publication Data

US 2014/0299329 A1 Oct. 9, 2014

Related U.S. Application Data

(60) Provisional application No. 61/883,156, filed on Sep. 26, 2013.

(51) Int. Cl.

| | |
|---|---|
| ***E21B 34/10*** | (2006.01) |
| ***E21B 21/10*** | (2006.01) |
| *E21B 34/00* | (2006.01) |

(52) U.S. Cl.
CPC ..... *E21B 34/10* (2013.01); *E21B 21/103* (2013.01); *E21B 34/102* (2013.01); *E21B 34/103* (2013.01); *E21B 2034/007* (2013.01)

(58) Field of Classification Search
CPC ..... E21B 34/10; E21B 34/102; E21B 34/103
See application file for complete search history.

(56) References Cited

U.S. PATENT DOCUMENTS

2009/0095486 A1* 4/2009 Williamson, Jr. .... E21B 21/103 166/373
2015/0041148 A1* 2/2015 Greenan ..... E21B 34/102 166/374

* cited by examiner

*Primary Examiner* — David Andrews
*Assistant Examiner* — Tara Schimpf

(57) ABSTRACT

A downhole tool and method of operation thereof is provided. The downhole tool may be configured to permit fluid communication between a combined flowbore of the casing string and the downhole tool and the subterranean formation or wellbore, or both, after a pressure test has been completed, a second threshold pressure is reached or applied, and a third threshold pressure has been applied to the downhole tool.

15 Claims, 10 Drawing Sheets

DOWNHOLE COMPLETION TOOL

CROSS REFERENCE TO RELATED APPLICATIONS

The present application claims priority to U.S. Prov. Appl. No. 61/883,156, filed on Sep. 26, 2013. The contents of the priority application are incorporated herein by reference to the extent consistent with the present disclosure.

BACKGROUND

During the completion process of a hydrocarbon-producing well in a subterranean formation, a conduit, such as a casing string, may be run into the wellbore to a predetermined depth and, in some instances, cemented in place to secure the casing string. Various "zones" in the subterranean formation may be isolated via the placement of one or more packers, which may also aid in securing the casing string and any completion equipment, e.g., fracturing equipment, in place in the wellbore. Following the placement and securing of the casing string and any completion equipment in the wellbore, a "pressure test" is typically performed to ensure that a leak or hole has not developed during the placement of the casing string and completion equipment.

Generally, a pressure test is conducted by pumping a fluid into a flowbore of the casing string, such that a predetermined pressure, typically related to the rated casing pressure, is applied to the casing string and completion equipment and maintained to ensure that a hole or leak does not exist in either. To do so, the casing string is configured such that no fluid passages out of the casing string are provided; thus, no ports or openings of the completion equipment, in addition to any other potential routes of fluid communication, may be open or available. After the pressure test is completed, further completion or production of the hydrocarbon-producing well may commence.

Accordingly, in order to either retrieve hydrocarbons and other fluids from the subterranean formation or to stimulate the subterranean formation, for example, via fracturing, one or more flowpaths may be created to provide communication between the flowbore and the wellbore or subterranean formation, or both, through the casing string. One method of providing such flowpaths includes the utilization of a perforating gun. In such a method, a perforating gun, typically including a string of shaped charges, is run down to the desired depth on, for example, E-line, coil tubing, or slickline. The shaped charges are detonated, thereby creating perforations in the casing string and hence the flowpaths between the subterranean formation, wellbore, and the flowbore. However, one disadvantage of perforating is "skin damage," where debris from the perforations may hinder productivity of the well. Another disadvantage of perforating is the cost and inefficiency of having to make a separate trip to run the perforating gun downhole.

Accordingly, in an effort to reduce the number of trips, another method of providing such flowpaths includes the utilization of a pressure activated tool, such as a differential valve, in the casing string. Generally, the differential valve is designed to open, creating such flowpaths, once a threshold pressure is reached; however, the differential valves generally may often be inaccurate as to the pressure at which they open and such valves also do not allow for closing once they have been opened. Thus, once a pressure test has been performed at or near the threshold pressure, the well will be open, thereby impairing or potentially eliminating the ability to control the wellbore, thereby posing various risks, such as blow-outs or the loss of hydrocarbons.

What is needed, then, is a downhole completion tool capable of undergoing a pressure test and subsequently providing flowpaths for production or stimulation fluids while maintaining wellbore control after the pressure test is completed.

SUMMARY

Embodiments of the disclosure may provide a downhole tool. The downhole tool may include a housing at least partially defining a flowbore therethrough and a plurality of fluid apertures. The downhole tool may also include an inner annular casing disposed in the housing and defining in conjunction with the housing an annular space. The downhole tool may further include an annular cover disposed in the annular space and configured to be displaced by a first piston at a first pressure applied to the flowbore and a biasing member at a second pressure applied to the flowbore. The downhole tool may also include a second piston at least partially disposed in the annular space and configured to be displaced by a force provided by a third pressure applied to the annular space via the flowbore, such that the plurality of fluid apertures and the flowbore are fluidly coupled.

Embodiments of the disclosure may further provide a method of servicing a subterranean formation. The method may include applying a first pressure to a first piston via a first port defined in an inner annular casing of a downhole tool including a housing at least partially defining a flowbore extending axially therethrough and in fluid communication with the first port. The method may also include displacing an annular cover axially via a force provided by the first pressure on the first piston, the annular cover shearing a first retention member configured to retain the annular cover prior to the application of the first pressure. The method may further include displacing a locking ring detachably attached to the annular cover, such that the locking ring detaches from the annular cover. The method may also include decreasing the first pressure to a second pressure such that the annular cover is axially displaced and the flowbore is fluidly coupled with an annular space defined at least in part by the housing and the inner annular casing. The method may further include applying a third pressure to the annular space via the flowbore. The method may also include displacing a second piston axially via a force provided by the third pressure on the second piston. The second piston may shear a second retention member configured to retain the second piston prior to the application of the third pressure, thereby fluidly coupling the subterranean formation and the flowbore via a plurality of housing apertures defined in the housing.

Embodiments of the disclosure may further provide a downhole tool configured to be disposed in a wellbore defined in a subterranean formation. The downhole tool may include a housing at least partially defining a flowbore therethrough and a plurality of fluid apertures. The downhole tool may also include an inner annular casing disposed in the housing and defining in conjunction with the housing an annular space. The inner annular casing may further define a casing flowpath and a first port configured to fluidly couple the flowbore and the casing flowpath. The downhole tool may further include an annular cover disposed in the annular space and configured to prevent fluid communication between the annular space and the flowbore during the application of a first pressure and to permit fluid communication between the annular space and the flowbore during the application of a second pressure and a third pressure. The downhole tool may also include a lower piston configured to engage the inner annular casing and prevent fluid communication between the flowbore and the wellbore via the plurality of fluid apertures at the application of the first pressure and the second pressure. The lower piston may be further configured to slidingly disengage with the inner annular casing and thereby permit fluid communication between the flowbore and the wellbore via the plurality of fluid apertures at the application of the third pressure. The downhole tool may further include an upper piston disposed in the casing flowpath and the annular space and configured to axially displace the annular cover at the application of the first pressure. The downhole tool may also include a biasing member configured to axially displace the upper piston and the annular cover to permit fluid communication between the annular space and the flowbore at the application of the second pressure. The downhole tool may further include a plurality of retention members. A first retention member of the plurality of retention members may be configured to retain the upper piston prior to the application of the first pressure and a second retention member of the plurality of retention members may be configured to retain the lower piston prior to the application of the third pressure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
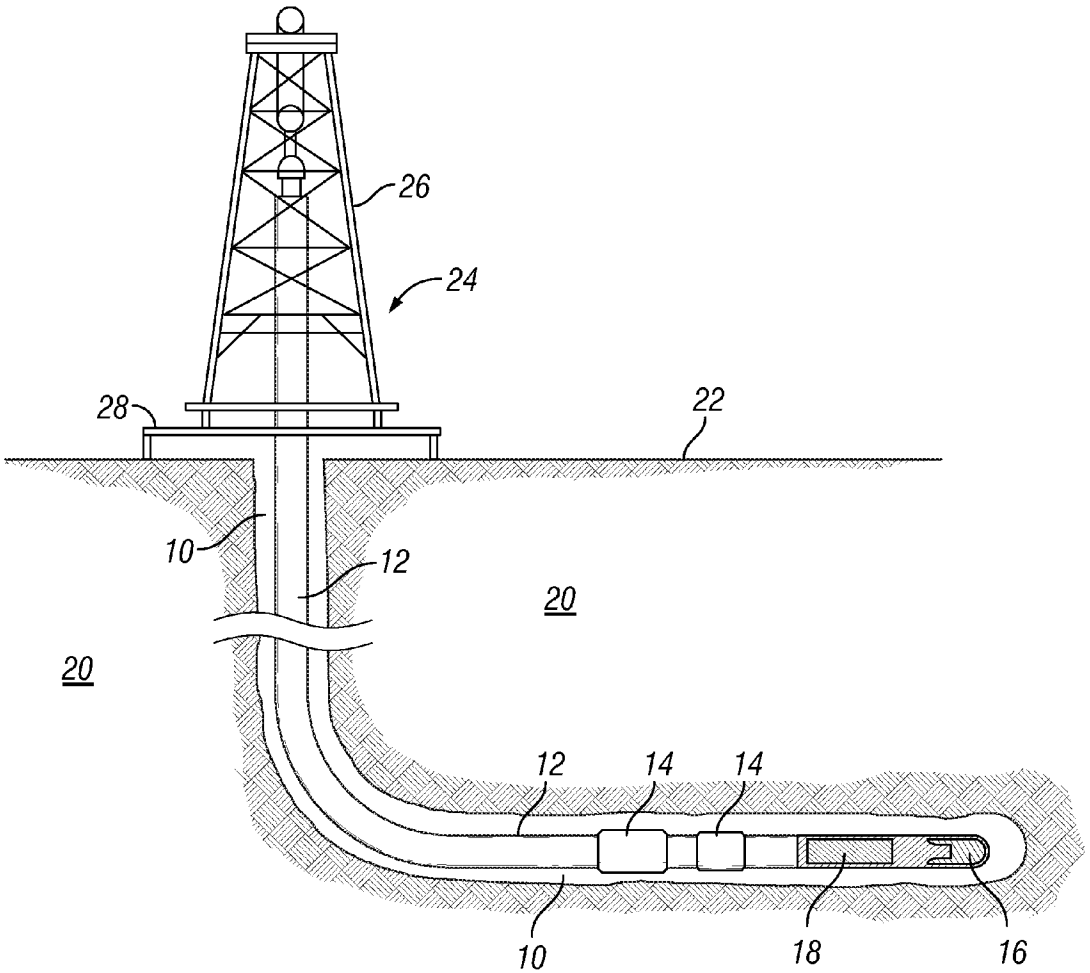
FIG. 1 illustrates a partial cutaway view of a wellbore defined in a subterranean formation, the wellbore having a casing string disposed therein and including one or more packers, a float shoe, and a downhole completion tool coupled thereto, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Unless otherwise specified, use of the terms "up," "upper," "upward," "uphole," "upstream," or other like terms shall be construed as generally toward the surface of the formation or the surface of a body of water; likewise, use of "down," "lower," "downward," "downhole," "downstream," or other like terms shall be construed as generally away from the surface of the formation or the surface of a body of water, regardless of the wellbore orientation. Use of any one or more of the foregoing terms shall not be construed as denoting positions along a perfectly vertical axis.

Turning now to the Figures, FIG. 1 illustrates a partial cutaway view of a wellbore 10 having a casing string 12 disposed therein and including one or more packers 14, a float shoe 16, and a downhole completion tool 18 coupled thereto, according to one or more embodiments disclosed. The wellbore 10 is defined by a subterranean formation 20 and is utilized for the retrieval of hydrocarbons therefrom. As illustrated, at least a portion of the wellbore 10 is oriented in a horizontal direction in the subterranean formation 20; however, embodiments in which the wellbore 10 is oriented in a conventional vertical direction are contemplated herein, and the depiction of the wellbore 10 in a horizontal or vertical direction is not to be construed as limiting the wellbore 10 to any particular configuration. Accordingly, in some embodiments, the wellbore 10 may extend into the subterranean formation 20 in a vertical direction, thereby having a vertical wellbore portion, and may deviate at any angle from the vertical wellbore portion, thereby having a deviated or horizontal wellbore portion. Thus, the wellbore 10 may be or include portions that may be vertical, horizontal, deviated, and/or curved.

As shown, the wellbore 10 is in fluid communication with the surface 22 via a rig 24 and/or other associated components positioned on the surface 22 around the wellbore 10. The rig 24 may be a drilling rig or a workover rig and may include a derrick 26 and a rig floor 28, through which the casing string 12 is positioned within the wellbore 10. In example embodiments, the casing string 12 includes the downhole completion tool 18 coupled to a first sub component 30 and a second sub component 32 (FIGS. 2A, 2C. 2E, 2G, 3A, 3C, 3E, and 3G) of the casing string 12. The downhole completion tool 18 may be delivered to a predetermined depth and positioned in the wellbore 10 via the rig 24 to perform in part a particular servicing operation including, for example, fracturing the subterranean formation 20, expanding or extending a flowpath therethrough, and/or producing hydrocarbons from the subterranean formation 20. In at least one embodiment, a portion of the casing string 12 may be secured into position in the subterranean formation 20 using cement. In another embodiment, the wellbore 10 may be partially cased and cemented such that a portion of the wellbore 10 is uncemented.

The rig 24 may be a conventional drilling or workover rig and may utilize a motor-driven winch and other associated equipment for lowering the casing string 12 and the downhole completion tool 18 to the desired depth. Although the rig 24 is depicted in FIG. 1 as a stationary drilling or workover rig, it will be appreciated by one of ordinary skill in the art that mobile workover rigs, wellbore servicing units (e.g., coil tubing units), and the like may be used to lower the downhole completion tool 18 into the wellbore 10. Additionally, it will be understood that the downhole completion tool 18 may be used in both onshore and offshore environments.

As noted above, in some embodiments, the downhole completion tool 18 is referred to as being coupled to components of a casing string 12, e.g., first and second sub components 30,32; however, it will be appreciated by one or ordinary skill in the art that the downhole completion tool 18 may be incorporated into other suitable tubular members. In at least one other embodiment, the downhole completion tool 18 may be incorporated into a liner. Further, the downhole completion tool 18 may be incorporated into a work string or like component.

Referring now to FIGS. 2A-2H and 3A-3H, the downhole completion tool 18 may be configured as depicted to permit fluid communication between a combined flowbore 34 of the casing string 12 and downhole completion tool 18 and the subterranean formation 20 or wellbore 10, or both, after a pressure test has been completed (i.e., at least a first threshold pressure has been applied to the casing string 12 and the downhole completion tool 18 and no leaks or holes exist), a second threshold pressure is reached or applied, and a third threshold pressure has been applied to the downhole completion tool 18. The downhole completion tool 18 may include a generally tubular-like, e.g., cylindrical, housing 36 having the flowbore 34 extending axially therethrough. The downhole completion tool 18 may further include a first end portion 38 and a second end portion 40 and may define a plurality of housing apertures 41 therebetween. As shown, the downhole completion tool 18 may be coupled to the first sub component 30 and the second sub component 32 of the casing string 12, according to some embodiments disclosed. In forming the coupling, the first end portion 38 of the housing 36 may include inner threads configured to engage outer threads of the first sub component 30 and to further form a sealing relationship via a first sub seal component 42, illustrated as an O-ring. Additionally, the second end portion 40 of the housing 36 may include inner threads configured to engage outer threads of the second sub component 32 and to further form a sealing relationship via a second sub seal component 44, illustrated as an O-ring. Other coupling methods known to those of skill in the art are contemplated herein including, for example, clamps.

The first sub component 30 may be further coupled to another portion of the casing string 12, a packer 14, or other associated drilling or completion component(s). The second sub component 32 may be further coupled to another portion of the casing string 12, the float shoe 16, or other associated drilling or completion component(s). In an exemplary embodiment, the downhole completion tool 18 may be coupled to the casing string 12 proximate the end portion or "toe" of the casing string 12.

As shown in FIGS. 2A-2H and 3A-3H, the downhole completion tool 18 may include an inner annular casing 46 and a lower piston 48 concentrically disposed in the housing 36 and defining in conjunction the flowbore 34 of the downhole completion tool 18. The lower piston 48 may be configured to slidingly fit against an inner surface 50 of the housing 36 and may have a first end portion 52 configured to slidingly engage a second end portion 54 of the inner annular casing 46 in a sealing relationship. The second end portion 54 of the inner annular casing 46 may form a shoulder 56 configured to receive and seat the first end portion 52 of the lower piston 48. The first end portion 52 of the lower piston 48 may define a plurality of grooves, such that a first seal component 58, illustrated as an O-ring, may be disposed in a first groove to form the sealing relationship with the second end portion 54 of the inner annular casing 46, and a second seal component 60, illustrated as an O-ring, may be disposed in a second groove to form a sealing relationship between the first end portion 52 of the lower piston 48 and the cylindrical housing 36. A plurality of retention members 62, illustrated as shear screws, may be utilized to retain the lower piston 48 seated and in a sealing relationship with the inner annular casing 46 prior to the third threshold pressure being applied thereto. The shear screws 62 may be inserted or disposed in corresponding suitable boreholes in the housing 36 and boreholes in the lower piston 48. As appreciated by one of ordinary skill in the art, the shear screws may be configured to shear or break when a desired magnitude of force is applied thereto. Although the retention members 62 are illustrated as shear screws, one or ordinary skill in the art will appreciate that the retention members 62 may be shear pins, lock rings, snap rings, or any other like component capable of retaining the lower piston 48 in the initial position.

The inner annular casing 46 further may define in conjunction with the cylindrical housing 36 an annular space 64 therebetween. In some embodiments, a biasing nut 66, a biasing member 68, a first annular component 70, a second annular component 72, an annular cover 74, a plurality of seal components 76,78, and at least a portion of an upper piston 80 may be disposed within the annular space 64. The annular space 64 may be in fluid communication with a casing flowpath 82 defined by a first end portion 84 of the inner annular casing 46. The upper piston 80 may include a piston head 86 and a piston rod 88, such that the piston head 86 may be disposed in the casing flowpath 82 and the piston rod 88 may be partially disposed in each of the annular space 64 and the casing flowpath 82. The upper piston 80 may be further configured to axially displace the annular cover 74 subject to forces applied to the piston head 86 by the first threshold pressure. The first end portion 84 of the inner annular casing 46 further defines a first port 90 in fluid communication with the casing flowpath 82 and the flowbore 34.

An end portion 92 of the piston rod 88 may be coupled or integral with a first end portion 94 of the annular cover 74 and configured to actuate the annular cover 74 such that the annular cover 74 moves axially within the annular space 64. One or more retention members 96, illustrated as shear screws, may be configured to retain the annular cover 74 in an initial position prior to the application of the first threshold pressure. The first annular component 70, illustrated as a shear ring in FIGS. 2A-2H and 3A-3H, may be disposed between the annular cover 74 and the cylindrical housing 36 and may retain the shear screws 96. In another embodiment, the annular cover 74 may retain the shear screws as shown in FIGS. 3A-3H.

In some embodiments, the first annular component 70 and the annular cover 74 may be a unitary piece; however, in other embodiments, the first annular component 70 and the annular cover 74 are respective individual components and arranged within the annular space 64 such that a fluid passageway 97 is defined therebetween, as shown in FIGS. 3A-3H. The shear screws 96 may be inserted or disposed in corresponding suitable boreholes in the annular cover 74 and at least one of suitable boreholes in the first annular component 70 and suitable boreholes in the inner annular casing 46. As appreciated by one of ordinary skill in the art, the shear screws 96 may be configured to shear or break when a desired magnitude of force is applied thereto. Although the retention members 96 are illustrated as shear screws, one or ordinary skill in the art will appreciate that the retention members 96 may be shear pins, lock rings, snap rings, or any other like component capable of retaining the annular cover 74 in the initial position.

In the initial position, in one or more embodiments, the annular cover 74 may cover a second port 98 defined in the inner annular casing 46 and prevent the second port 98 from fluidly communicating with the annular space 64 as shown in FIGS. 2A-2D. In some embodiments, the annular cover 74 may be an annular sleeve. The annular cover 74 may further define a plurality of grooves, each groove retaining a respective seal component 76,78, illustrated as an O-ring, to provide a sealing relationship between the annular cover 74 and the inner annular casing 46, thereby preventing fluid communication between the second port 98 and the annular space 64.

A recessed end portion 100 of the first annular component 70 may form a shoulder 102 configured to seat the second annular component 72, illustrated as a locking ring, when the annular cover 74 is in the initial position. The locking ring 72 may be detachably attached to a second end portion 104 of the annular cover 74. In another embodiment, annular cover may include a plurality of components including a spring spacer (not shown) spaced apart from a main body of the annular cover 74 in the initial position. Accordingly, the locking ring 72 may be detachably attached to the spring spacer adjacent the main body of the annular cover 74.

In the initial position, the locking ring 72 may be detachably attached to the annular cover 74 such that the annular cover 74 is fixed. The recessed end portion 100 of the first annular component 70 may further form a lip 106, such that the lip 106 may be configured to seat the locking ring 72 after the locking ring 72 has been axially displaced. The locking ring 72 may be further configured to release or detach from the second end portion 104 of the annular cover 74 when seated on the lip 106. In an embodiment in which the first annular component 70 and annular cover 74 are a unitary piece, the annular space 64 may include a protrusion disposed therein and integral or coupled with the inner surface 50 of the housing 36 to seat the locking ring 72 after the locking ring 72 is displaced axially downstream by the unitary piece including the first annular component 70 and the annular cover 74.

The biasing member 68, illustrated as a spring in the embodiments of FIGS. 2A-2H and 3A-3H, may be disposed in the annular space 64 and configured to expand and compress based on the positioning of the biasing nut 66 and the locking ring 72. The locking ring 72 in the initial position may be seated on the shoulder 102 formed on the first annular component 70 and is thereby positioned to compress the spring 68 against the biasing nut 66, such that the spring 68 may store mechanical energy and is prohibited from forcing the axial displacement of the annular cover 74. The spring rate of the spring 68 may be based at least in part on the pressure in the annular space 64 in which it is disposed. The positioning of the biasing nut 66 may also determine in part the third threshold pressure to be applied to the downhole completion tool 18.

The annular space 64 may be pressurized to be or include a pressurized chamber. In an exemplary embodiment, the annular space 64 is a pressurized chamber having a pressure substantially equal to one atmospheric unit (1 atm). In another embodiment, the pressurized chamber may have a pressure greater than 1 atm. To provide the pressurized chamber at atmospheric pressure, the pressurized chamber may be sealed prior to the downhole completion tool 18 being run downhole, such that the pressurized chamber may be maintained at atmospheric pressure at the predetermined depth of the downhole completion tool 18 at the initial position.

Operation of the downhole completion tool 18 may now be disclosed herein, according to at least some embodiments of the present disclosure. As shown in FIG. 1, the downhole completion tool 18 may be positioned by "running in" the casing string 12 to the desired depth or location in the wellbore 10. As shown, the casing string 12 may include the downhole completion tool 18, and may be integrated with or coupled to the first sub component 30 and the second sub component 32 as shown in the embodiments of FIGS. 2A-2H and 3A-3H. As such, the downhole completion tool 18 and the casing string 12 have a common flowbore 34, through which fluid may be communicated to and/or from the surface 22. Accordingly, fluid introduced into the casing string 12 at the surface 22 may flow through the downhole completion tool 18 and fluid introduced from the subterranean formation 20 to the downhole completion tool 18 may flow through the casing string 12.

Depending on the design of the hydrocarbon-producing well, none, a portion of, or substantially all of the casing string 12 may be cemented in place to secure the casing string 12 in the wellbore 10. Optionally, one or more packers 14 and/or the float shoe 16 may be provided in the wellbore 10 as shown in FIG. 1. One of ordinary skill in the art will appreciate that other components may be disposed in the wellbore 10 based on at least design choices and the subterranean formation 20. Upon cementing the casing string 12 in the wellbore 10, a pressure test may be performed to ensure that no leaks or holes are present in the wellbore 10 that may compromise the integrity of the hydrocarbon-producing well.

Figure 2A:
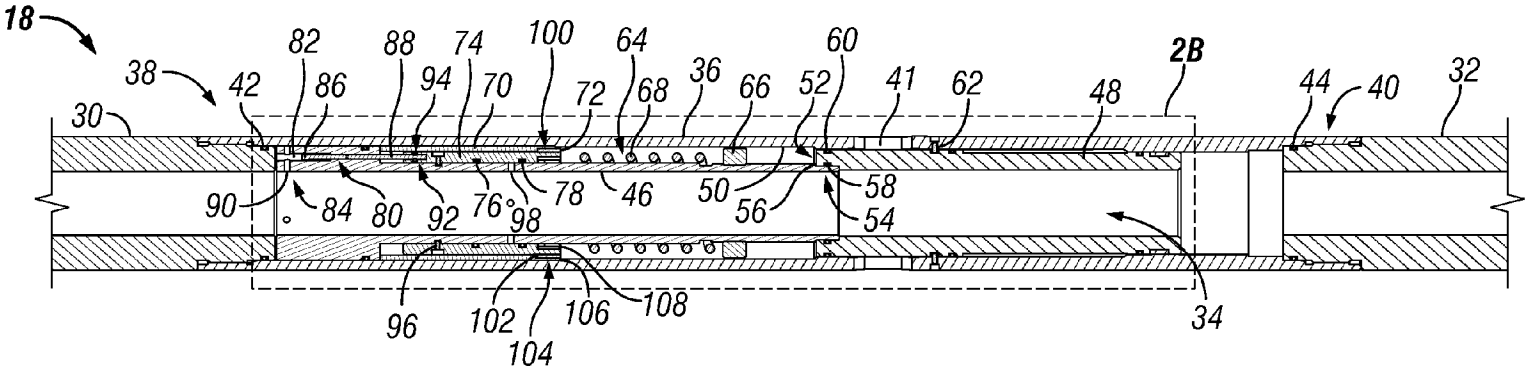
FIG. 2A illustrates a cross-sectional view of the downhole completion tool of FIG. 1 coupled to a top sub component and a bottom sub component of the casing string, the downhole tool shown as configured in an initial position prior to the application of a first threshold pressure, according to one or more embodiments disclosed.
Figure 2B:
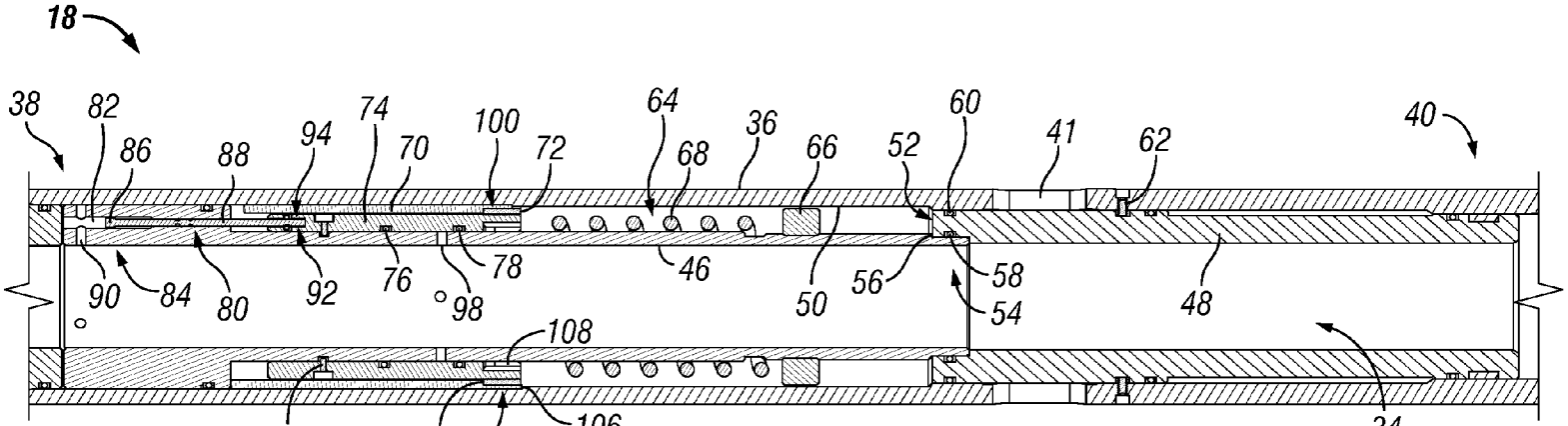
FIG. 2B illustrates an enlarged view of the encircled portion of the downhole completion tool labeled "2B' in FIG. 2A, according to one or more embodiments disclosed.
Figure 3A:
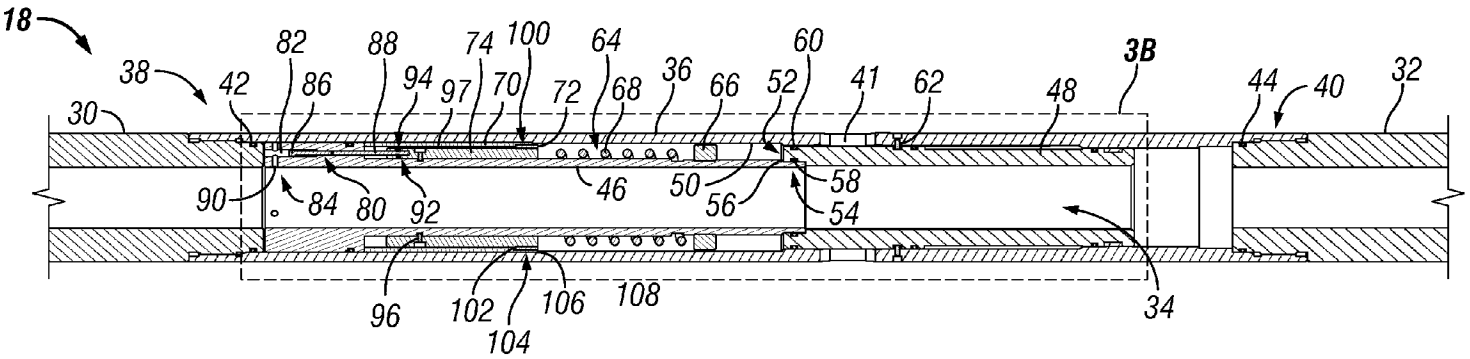
FIG. 3A illustrates a cross-sectional view of the downhole completion tool of FIG. 1 coupled to the top sub component and the bottom sub component of the casing string, the downhole tool shown as configured in an initial position prior to the application of a first threshold pressure, according to one or more embodiments disclosed.
Figure 3B:
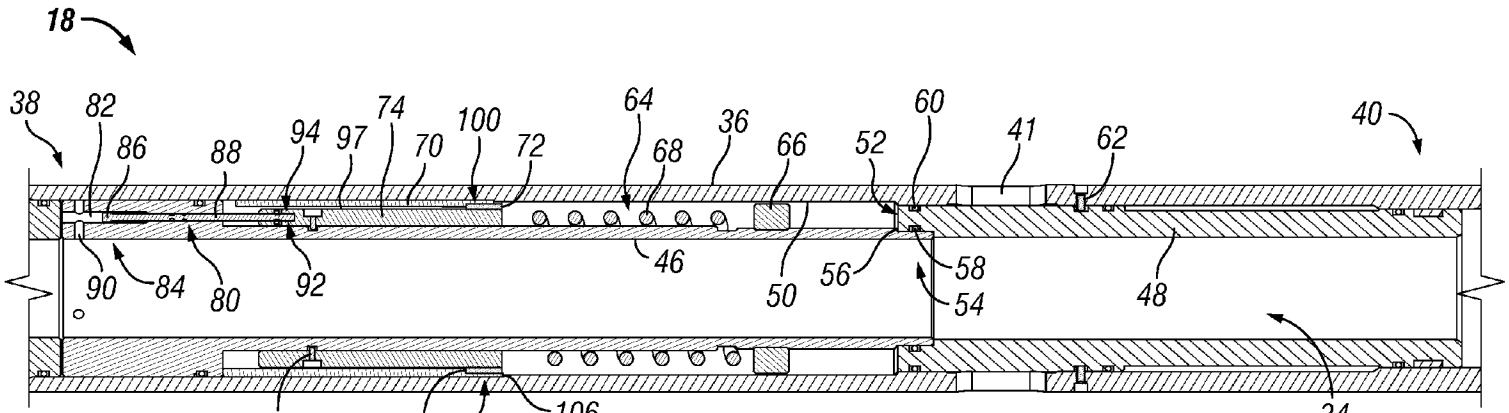
FIG. 3B illustrates an enlarged view of the encircled portion of the downhole completion tool labeled "3B' in FIG. 3A, according to one or more embodiments disclosed.
Figure 3C:
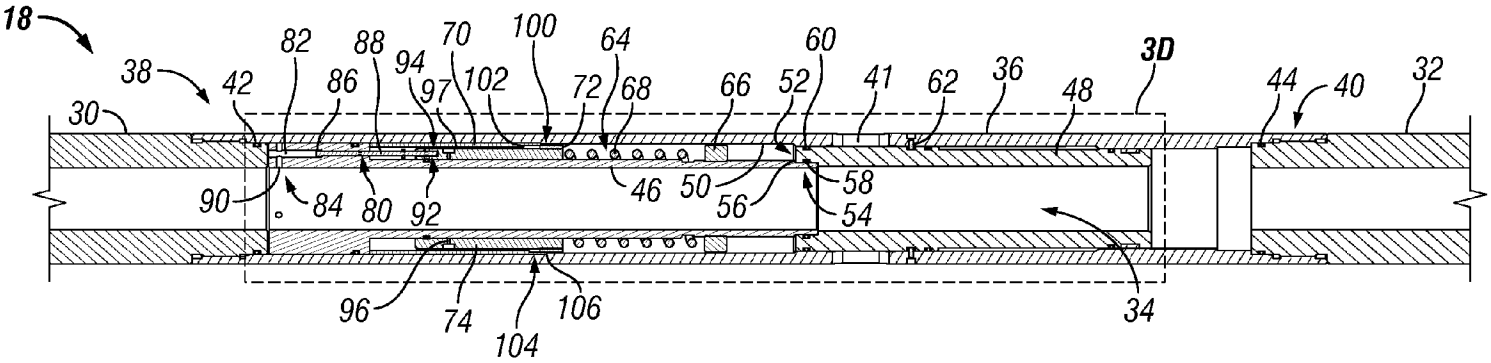
FIG. 3C illustrates a cross-sectional view of the downhole completion tool of FIG. 1 coupled to the top sub component and the bottom sub component of the casing string, the downhole tool shown as configured after the application of the first threshold pressure, according to one or more embodiments disclosed.
Figure 3D:
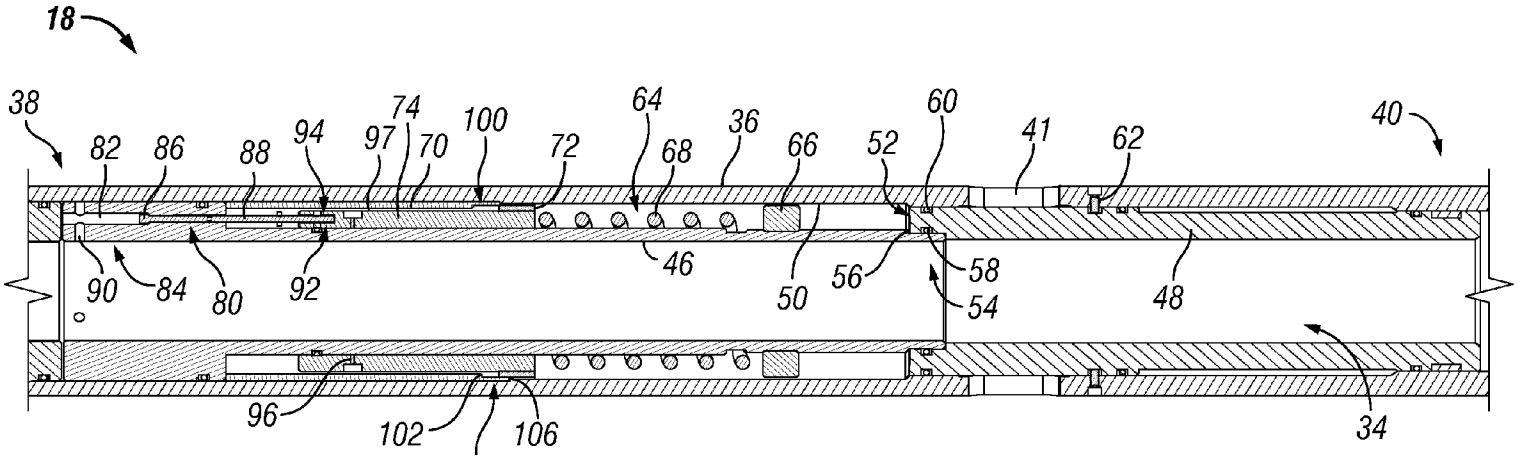
FIG. 3D illustrates an enlarged view of the encircled portion of the downhole completion tool labeled "3D' in FIG. 3C, according to one or more embodiments disclosed.

As initially positioned in the wellbore 10 and prior to the initiation of the pressure test, the downhole completion tool 18 may be configured as depicted in FIGS. 2A and 2B in at least one embodiment. In another embodiment, the downhole completion tool 18 may be configured as depicted in FIGS. 3A and 3B. Accordingly, in either the embodiment of FIGS. 2A and 2B or the embodiment of FIGS. 3A and 3B, the downhole completion tool 18 may be referred to as being in a "run in" or initial position. In the initial position, the first port 90 may be in fluid communication with the flowbore 34 and the casing flowpath 82. The piston head 86 of the upper piston 80 may be disposed in the casing flowpath 82 and subjected to an initial pressure of the flowbore 34. In an exemplary embodiment, the initial pressure may be the hydrostatic pressure in the wellbore 10. In the initial position, the initial pressure is less than the first threshold pressure. As shown in FIGS. 2A and 2B and FIGS. 3A and 3B, the piston rod 88 may be coupled or integral with the annular cover 74 and thereby may be configured to displace the annular cover 74 dependent on pressure applied to the piston head 86. At the initial pressure, the applied pressure to the piston head 86 is not sufficient to cause the piston rod 88 to displace the annular cover 74 from the location depicted in FIGS. 2A and 2B and FIGS. 3A and 3B. Accordingly, the annular cover 74 may be retained in the initial position via the shear screws 96 retained by the first annular component 70 (or annular cover 74 as shown in FIGS. 3A and 3B).

In the embodiment illustrated in FIGS. 2A and 2B, the annular cover 74 may be positioned such that the annular cover 74 seals the flowbore 34 from the annular space 64. To do so, the annular cover 74 in the initial position may be positioned over the second port 98, such that a respective seal component 76,78 may be disposed between the annular cover 74 and the inner annular casing 46 on either side of the second port 98. Accordingly, the initial pressure in the flowbore 34 may be applied only to the casing flowpath 82 and the upper piston 80 via the first port 90 in the initial position as shown in FIGS. 2A and 2B and FIGS. 3A and 3B.

The second end portion 104 of the annular cover 74 may be detachably attached to the locking ring 72 as shown in FIGS. 2A and 2B and FIGS. 3A and 3B. Although illustrated as a unitary component, the annular cover 74 may be formed from a plurality of components. As shown in the embodiment of FIGS. 2A and 2B, the second end portion 104 of the annular cover 74 may define an annular cover flowpath 108 fluidly coupled to the portion of the pressurized chamber formed between the annular cover 74 and the lower piston 48 disposed in the annular space 64. In an exemplary embodiment, the pressurized chamber may be at about atmospheric pressure (1 atm); however, the pressurized chamber may be at pressures greater than atmospheric pressure depending on the spring rate of the spring 68.

The locking ring 72 may be a circlip, snap ring, or any other retaining ring capable of retaining the annular cover 74 in the initial position. The locking ring 72 may be disposed and seated on the shoulder 102 formed on the first annular component 70 in the initial position. The locking ring 72 may utilize the support of the shoulder 102 to counter the forces provided by the spring 68 against the annular cover 74 retained by the locking ring 72.

The spring 68 may apply a force consistent with the spring rate and the location of the biasing nut 66 in the pressurized chamber of the annular space 64. The spring rate and the placement of the biasing nut 68 may be determined based in part on at least one of the first threshold pressure, the third threshold pressure, and the pressure in the pressurized chamber of the annular space 64. In the initial position, the spring 68 may apply a force to the annular cover 74; however, the force provided by the spring 68 based on the aforementioned parameters may not be sufficient to displace the annular cover 74 based at least on the locking ring 72 being disposed and seated on the shoulder 102 of the first annular component 70.

The lower piston 48 is depicted in FIGS. 2A and 2B and FIGS. 3A and 3B in the initial position covering the housing apertures 41 defined in the housing 36, thereby preventing fluid communication between the casing string 12 and the subterranean formation 20 or wellbore 10, or both. In the initial position, the first end portion 52 of the lower piston 48 may be disposed in the pressurized chamber of the annular space 64 and may be seated on the second end portion 54 of the inner annular casing 46. As the first end portion 52 of the lower piston 48 is subjected to the pressure of the pressurized chamber of the annular space 64, a sufficient force may not be applied to the first end portion 52 of the lower piston 48 to displace the lower piston 48 in the annular space 64.

After the casing string 12 and downhole completion tool 18 are run in the wellbore 10, a pressure test may be performed. Accordingly, a first threshold pressure may be applied to the casing string 12 and the downhole completion tool 18 as depicted in FIGS. 2C and 2D and FIGS. 3C and 3D, according to at least some embodiments of the present disclosure. In this position, the downhole completion tool 18 may be referred to as being in a first threshold position. The first threshold pressure may be substantially equal to or less than the casing test pressure or the rated casing pressure. In an exemplary embodiment, the first threshold pressure is about seventy percent of the casing test pressure. In another embodiment, the first threshold pressure is about seventy percent of the casing test pressure. In another embodiment, the first threshold pressure is about seventy-five percent of the casing test pressure. In another embodiment, the first threshold pressure is about eighty percent of the casing test pressure. In another embodiment, the first threshold pressure is about eighty-five percent of the casing test pressure. In another embodiment, the first threshold pressure is about ninety percent of the casing test pressure. In another embodiment, the first threshold pressure is about ninety-five percent of the casing test pressure. One of ordinary skill in the art will appreciate that the casing test pressure may be dependent at least in part on the rated casing pressure, and accordingly, the casing test pressure chosen for the pressure test may vary depending on the casing string 12 utilized in the wellbore 10.

As the first threshold pressure is applied to the casing string 12 and the downhole completion tool 18 via fluid pumped through the casing string 12 from the surface 22, fluid is flowed through the first port 90 causing a force correlating to the first threshold pressure to be applied to the piston head 86 of the upper piston 80 disposed in the casing flowpath 82. The force is sufficient to displace the annular cover 74 via the piston rod 88 and to shear the shear screws 96 retaining the annular cover 74 in the initial position. As the annular cover 74 is axially displaced, the locking ring 72 coupled to the second end portion 104 of the annular cover 74 is axially displaced downstream from the seated position on the shoulder 102 of the first annular component 70 and is axially shifted along the first annular component 70. As the locking ring 72 reaches the lip 106 of the first annular component 70, the locking ring 72 expands and presses against an inner surface 50 of the housing 36 and abuts or is seated on the lip 106 of the first annular component 70 such that the locking ring 72 is prohibited from moving axially upstream. As the locking ring 72 expands, the locking ring 72 detaches from the second end portion 104 of the annular cover 74, such that the annular cover 74 and the locking ring 72 are no longer attached to one another. The annular cover 74 may be retained adjacent the locking ring 72 seated on the lip 106 of the first annular component 70 until the application of the first threshold pressure is ceased and the pressure in the flowbore 34 begins to bleed down.

Figure 2C:
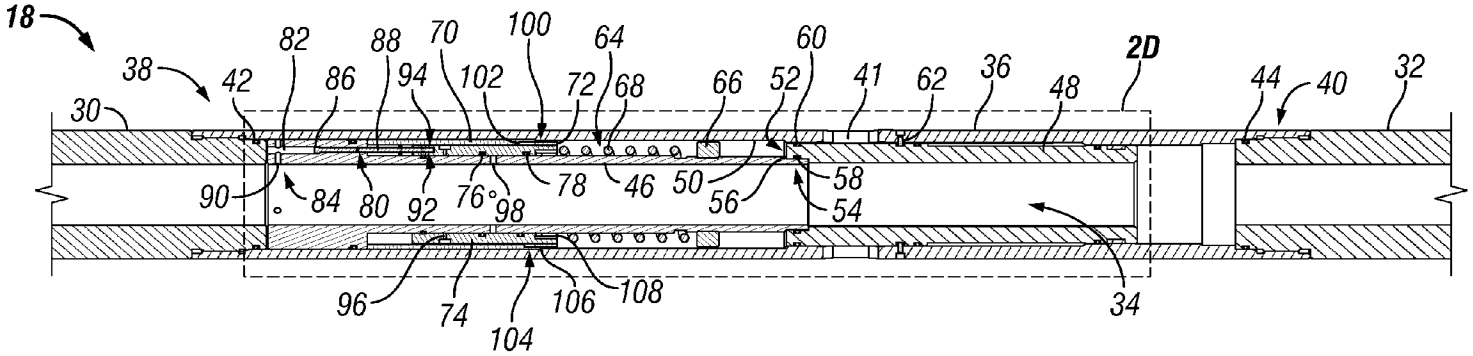
FIG. 2C illustrates a cross-sectional view of the downhole completion tool of FIG. 1 coupled to the top sub component and the bottom sub component of the casing string, the downhole tool shown as configured after the application of the first threshold pressure, according to one or more embodiments disclosed.
Figure 2D:
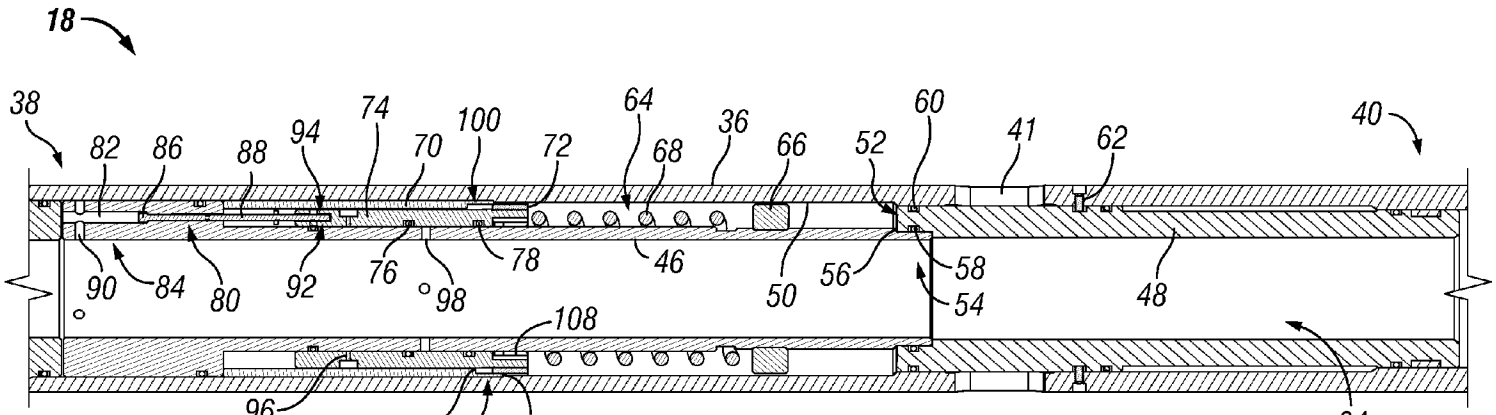
FIG. 2D illustrates an enlarged view of the encircled portion of the downhole completion tool labeled "2D' in FIG. 2C, according to one or more embodiments disclosed.

In the first threshold position, the annular cover 74 may be urged by the upper piston 80 with a magnitude of force sufficient to further compress the spring 68 in the position as indicated in FIGS. 2C and 2D and FIGS. 3C and 3D, thereby providing stored mechanical energy to the spring 68. In the first threshold position, the annular cover 74 may be axially displaced to expand the locking ring 72 and decouple the locking ring 72 from the annular cover 74; however, the annular cover 74 may remain positioned over the second port 98, such that a respective seal 76,78 may be disposed between the annular cover 74 and the inner annular casing 46 on either side of the second port 98, as shown in the embodiment of FIGS. 2C and 2D. Accordingly, the first threshold pressure in the flowbore 34 may be applied only to the casing flowpath 82 and upper piston 80 via the first port 90 in the first threshold position.

As the first threshold pressure in the flowbore 34 may be applied only to the casing flowpath 82 and upper piston 80 via the first port 90 in the first threshold position, the pressurized chamber may remain at atmospheric pressure. Accordingly, the lower piston 48 may remain statically disposed and seated on the shoulder 56 of the second end portion 54 of the inner annular casing 46. In the first threshold position, the lower piston 48 prevents fluid communication between the housing apertures 41 and the flowbore 34 of the downhole completion tool 18. Thus, the downhole completion tool 18 may allow for a pressure build up in the flowbore 34 indicative of a pressure test without allowing for any leakage or flow to and/or from the subterranean formation 20 in the first threshold position.

After performing the pressure test and achieving the first threshold pressure in the downhole completion tool 18 and the casing string 12, the first threshold pressure may be allowed to bleed down to reduce the pressure in the downhole completion tool 18 and casing string 12 to a bleed down pressure, or second threshold pressure. As positioned in the wellbore 10 after the pressure has been bled down from the first threshold pressure to the second threshold pressure, the downhole completion tool 18 may be configured as depicted in FIGS. 2E and 2F and FIGS. 3E and 3F. Accordingly, the downhole completion tool 18 may be referred to as being in a "bled down" or second threshold position. In the second threshold position, the pressure in the downhole completion tool 18 may be reduced to a second threshold pressure having a pressure at or substantially equal to the initial pressure in the wellbore 10. In another embodiment, the pressure in the downhole completion tool 18 may be reduced to a second threshold pressure having a pressure at or substantially equal to the hydrostatic pressure in the wellbore 10. In other embodiments, the pressure in the downhole completion tool 18 may be reduced to a second threshold pressure having a pressure at or substantially equal to about 0 psig, about 250 psig, about 500 psig, about 750 psig, about 1000 psig, about 1250 psig, or about 1500 psig.

As shown in FIGS. 2E and 2F and FIGS. 3E and 3F, as the pressure is bled down to the second threshold pressure, the mechanical energy stored in the spring 68 may be released in the form of a force applied to the second end portion 104 of the annular cover 74, which may be greater than the force applied to the piston head 86 by the pressure of the fluid flowing through the casing flowpath 82 via the first port 90. Accordingly, the spring 68 may decompress or expand from the state of the spring 68 in the first threshold position. As the spring 68 decompresses, the spring 68 applies a force to the annular cover 74 thereby retracting or displacing the annular cover 74 upstream in an axial direction. The annular cover 74 may be axially displaced upstream and prohibited from further axial movement upstream by the first sub component 30. In this location, the annular cover 74 is disposed in the casing flowpath 82 as depicted in FIGS. 2E and 2F and FIGS. 3E and 3F.

Figure 2E:
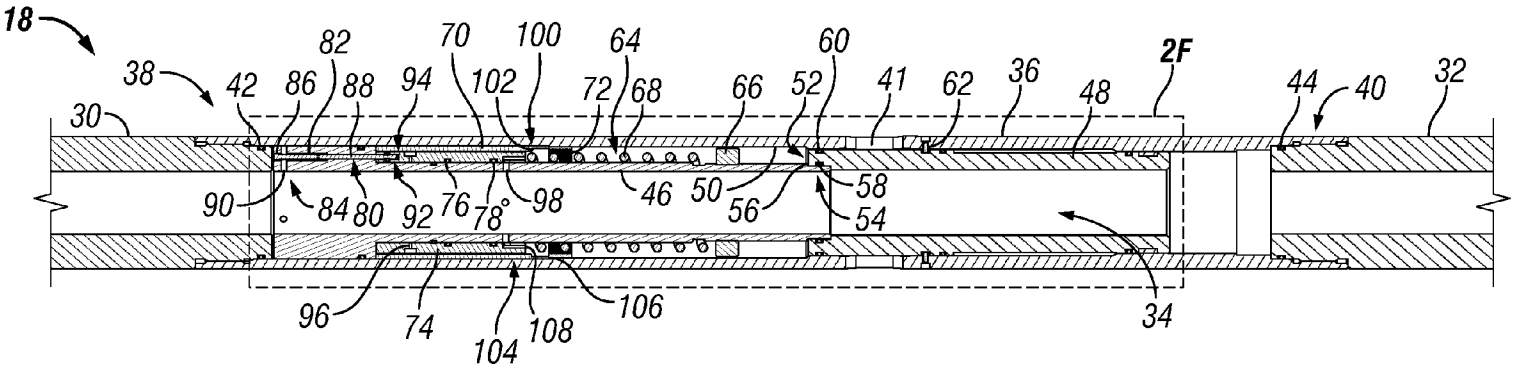
FIG. 2E illustrates a cross-sectional view of the downhole completion tool of FIG. 1 coupled to the top sub component and the bottom sub component of the casing string, the downhole tool shown as configured after the bleed down of the first threshold pressure to a second threshold pressure, according to one or more embodiments disclosed.
Figure 2F:
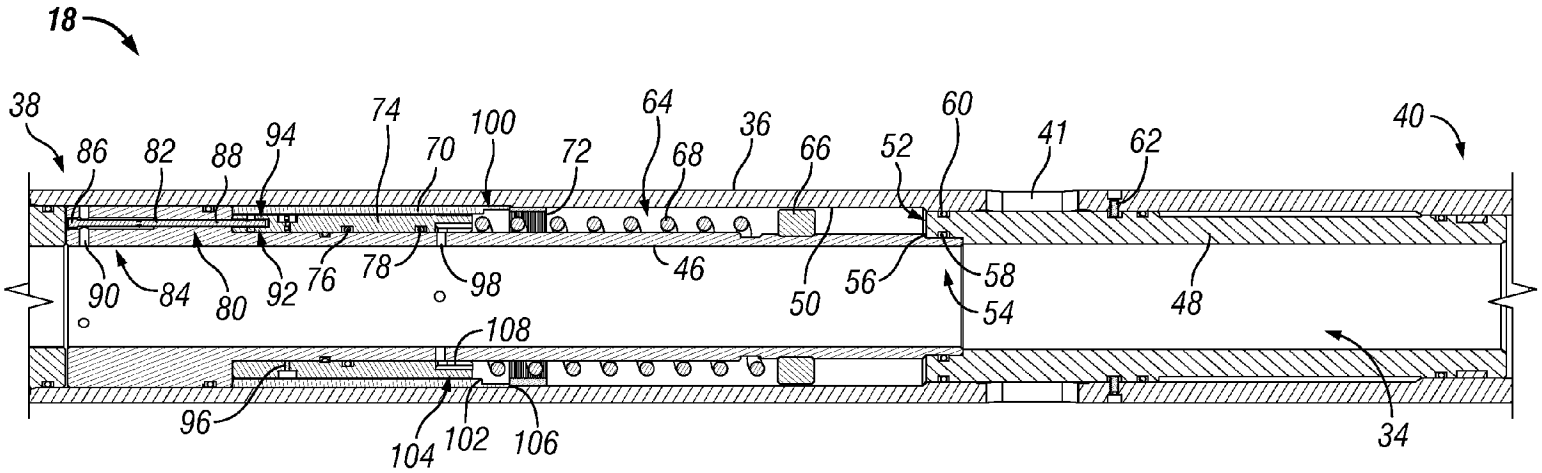
FIG. 2F illustrates an enlarged view of the encircled portion of the downhole completion tool labeled "2F' in FIG. 2E, according to one or more embodiments disclosed.

As shown in the embodiment of FIGS. 2E and 2F, in the second threshold position, the spring 68 may expand and retain the annular cover 74 in contact with or adjacent the first sub component 30 such that fluid may be prevented or substantially restricted from flowing into the casing flowpath 82 via the first port 90. Accordingly, in the second threshold position, the second end portion 104 of the annular cover 74 may be disposed in the downhole completion tool 18 such that the annular cover flowpath 108 defined in the annular cover 74 may be substantially aligned with the second port 98 of the inner annular casing 46 such that the annular cover flowpath 108 may be in fluid communication with the flowbore 34 via the second port 98. Correspondingly, as the annular cover flowpath 108 may be in fluid communication with the pressurized chamber of the annular space 64, the flowbore 34 may be in fluid communication with the pressurized chamber via the second port 98 and the annular cover flowpath 108. The pressurized chamber may be at a pressure less than or substantially equal to the pressure in the flowbore 34 and the casing string 12 of the downhole completion tool 18, such that there may be no pressure differential or there may be a positive pressure differential from the pressure in the flowbore 34 and the casing string 12 of the downhole completion tool 18 to the pressurized chamber.

Figure 3E:
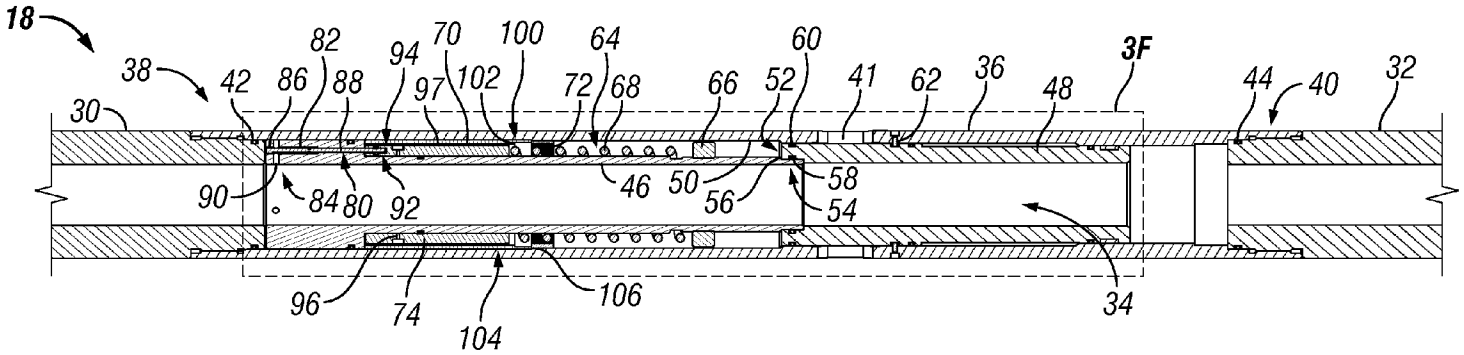
FIG. 3E illustrates a cross-sectional view of the downhole completion tool of FIG. 1 coupled to the top sub component and the bottom sub component of the casing string, the downhole tool shown as configured after the bleed down of the first threshold pressure to a second threshold pressure, according to one or more embodiments disclosed.
Figure 3F:
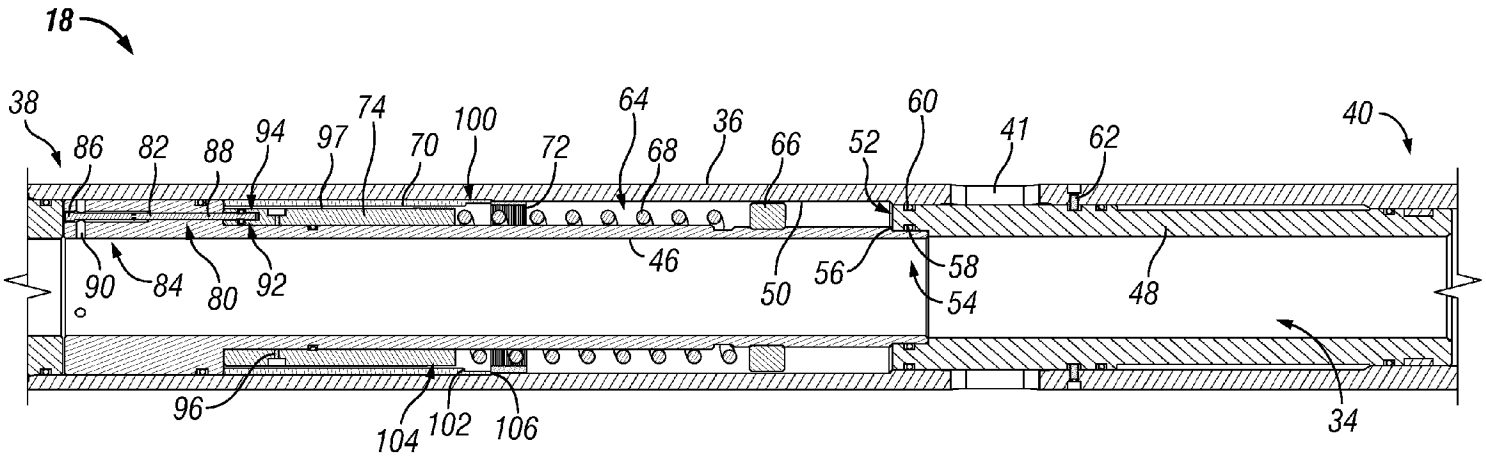
FIG. 3F illustrates an enlarged view of the encircled portion of the downhole completion tool labeled "3F' in FIG. 3E, according to one or more embodiments disclosed.
Figure 3G:
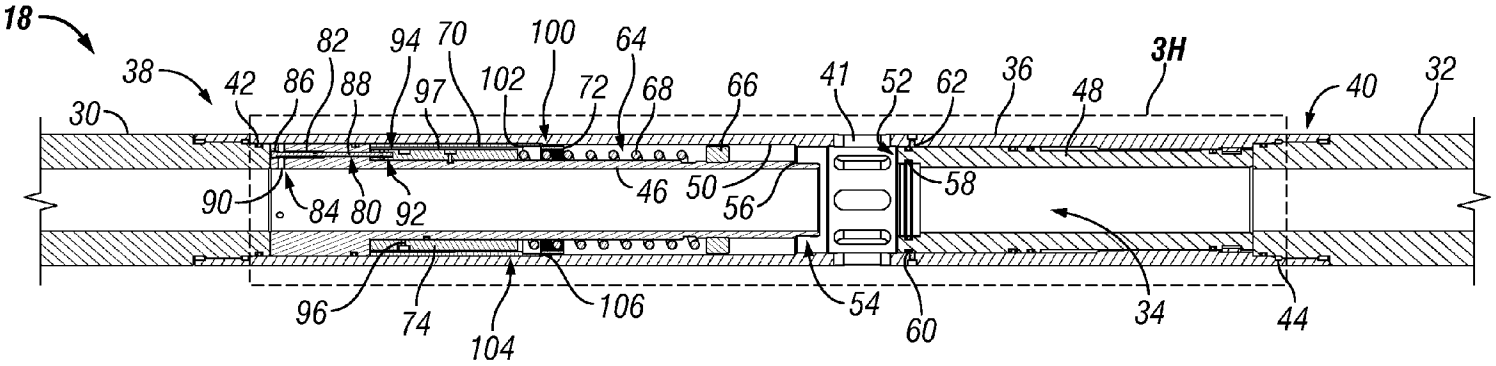
FIG. 3G illustrates a cross-sectional view of the downhole completion tool of FIG. 1 coupled to the top sub component and the bottom sub component of the casing string, the downhole tool shown as configured after the application of a third threshold pressure, according to one or more embodiments disclosed.
Figure 3H:
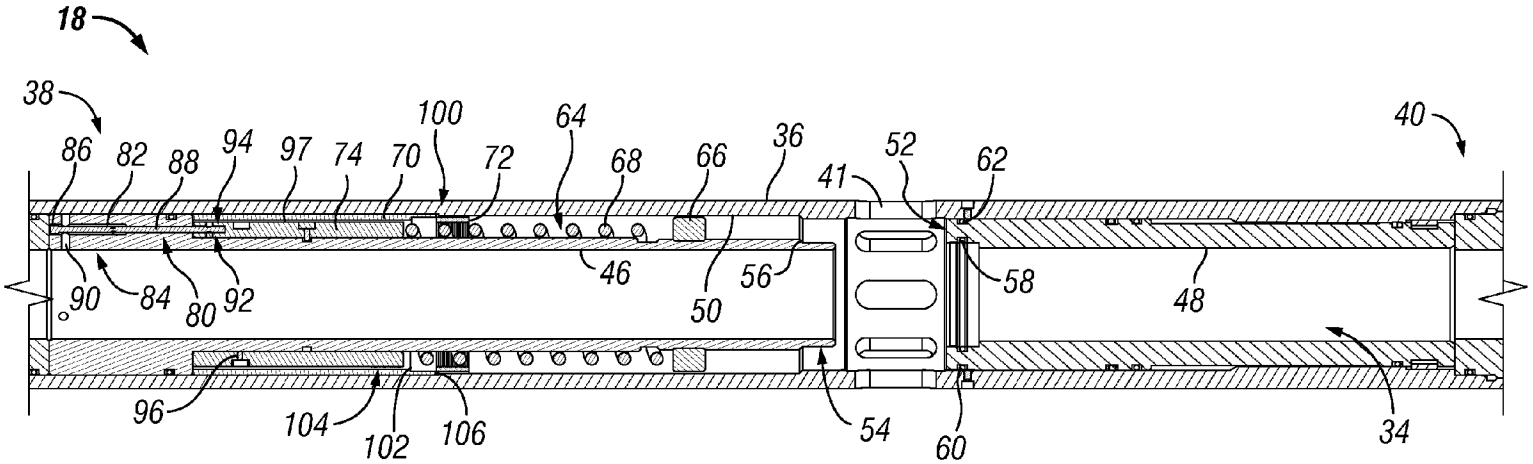
FIG. 3H illustrates an enlarged view of the encircled portion of the downhole completion tool labeled "3H' in FIG. 3G, according to one or more embodiments disclosed.

In the embodiment illustrated in FIGS. 3E and 3F, in the second threshold position, the spring 68 may expand and retain the annular cover 74 in contact with or adjacent the first sub component 30; however, fluid may be permitted to flow into the casing flowpath 82 via the first port 90. Accordingly, in the second threshold position, the casing flowpath 82 may be in fluid communication with the fluid passageway 97 defined between the annular cover 74 and the first annular component 70 such that fluid may flow via the first port 90 into the casing flowpath 82 and through the fluid passageway 97 into the annular space 64. Thus, the flowbore 34 may be in fluid communication with the pressurized chamber of the annular space 64 via the first port 90, the casing flowpath 82, and the fluid passageway 97. The pressurized chamber may be at a pressure less than or substantially equal to the pressure in the flowbore 34 and the casing string 12 of the downhole completion tool 18, such that there may be no pressure differential or there may be a positive pressure differential from the pressure in the flowbore 34 and the casing string 12 of the downhole completion tool 18 to the pressurized chamber.

As depicted in FIGS. 2E and 2F and FIGS. 3E and 3F, the pressure in the pressurized chamber in the second threshold position may be insufficient to displace the lower piston 48 partially disposed in the annular space 64. The lower piston 48 may be retained in place by the shear screws 62, which may be rated to retain the lower piston 48 in the second threshold position until the third threshold pressure is reached in the pressurized chamber. Accordingly, in the second threshold position, the lower piston 48 may be positioned in the downhole tool 18 to prohibit fluid flowing through the casing string 12 and flowbore 34 from communicating with the subterranean formation 20 via the housing apertures 41. Corresponding, in the second threshold position, the lower piston 48 may be positioned in the downhole tool 18 to prohibit fluid flowing through the subterranean formation 20 from communicating with the casing string 12 and flowbore 34 via the housing apertures 41.

Thus, as depicted in FIGS. 2E and 2F and FIGS. 3E and 3F, portions of the downhole completion tool 18 may be arranged accordingly after undergoing a pressure cycle including a first threshold pressure consistent with or in the range of a pressure associated with a pressure test to evaluate for leaks or openings in the casing string 12 and downhole completion tool 18. As configured in the second threshold position, the downhole completion tool 18 may be referred to as "armed" and capable of providing a flowpath to and/or from the subterranean formation 20 after the application of the third threshold pressure without an additional trip down hole by the operator. By eliminating an additional trip downhole, the downhole completion tool 18 as described herein provides for a reduction in time completing the well and corresponding savings in financial resources.

After the third threshold pressure may be applied to the casing string 12 and the downhole completion tool 18 in the second pressure cycle, the downhole completion tool 18 may be configured as depicted in the respective embodiments of FIGS. 2G and 2H and FIGS. 3G and 3H. Accordingly, the downhole completion tool 18 may be referred to as being in a "flowthrough" or final position. In the final position, the flowbore 34 of the downhole completion tool 18 may be in fluid communication with the subterranean formation 20 or the wellbore 10, or both, via the housing apertures 41, thereby allowing for the stimulation of the subterranean formation 20 and/or the retrieval of hydrocarbons from the subterranean formation 20.

The arrangement of the downhole completion tool 18 as depicted in FIGS. 2G and 2H and FIGS. 3G and 3H in the final position may be accomplished by providing the third threshold pressure to the downhole completion tool 18 as arranged in FIGS. 2E and 2F and FIGS. 3E and 3F, respectively, in the second threshold position. Accordingly, the third threshold pressure may be applied to the casing string 12 and downhole completion tool 18 via fluid provided from the surface 22 and pumped downhole via one or more pumps. The third threshold pressure may be greater than the pressure in the wellbore 10 after the wellbore 10 is bled down to the second threshold pressure from the first threshold pressure.

The third threshold pressure may be determined at least in part by design parameters, including, for example, the rating of the shear screws 62 retaining the lower piston 48 in place and the pressure in the pressurized chamber of the annular space 64. In another embodiment, the third threshold pressure may be determined at least in part by the characteristics of the subterranean formation 20, e.g., type of rock, porosity, and permeability. In an operative example, the third threshold pressure may be at least about 2000 psig. In another operative example, the third threshold pressure may be at least about 500 psig. Still yet, in other operative examples, the third threshold pressure may be at least about 1000 psig, at least about 1500 psig, at least about 2500 psig, at least about 3000 psig, at least about 3500 psig, at least about 4000 psig, at least about 4500 psig, or at least about 5000 psig.

Figure 2G:
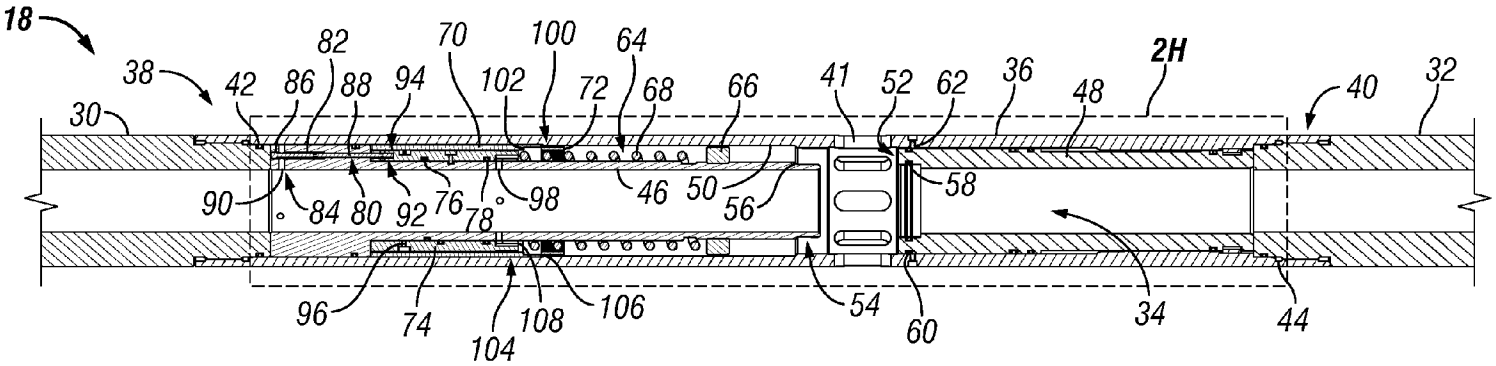
FIG. 2G illustrates a cross-sectional view of the downhole completion tool of FIG. 1 coupled to the top sub component and the bottom sub component of the casing string, the downhole tool shown as configured after the application of a third threshold pressure, according to one or more embodiments disclosed.
Figure 2H:
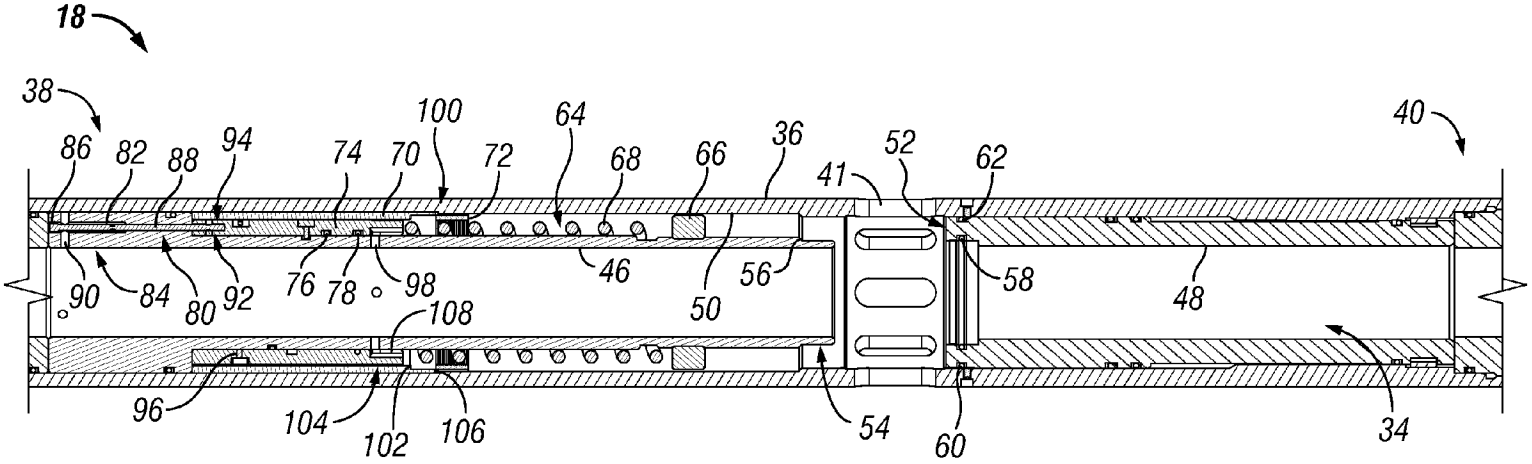
FIG. 2H illustrates an enlarged view of the encircled portion of the downhole completion tool labeled "2H' in FIG. 2G, according to one or more embodiments disclosed.

In an exemplary embodiment, the third threshold pressure may be applied to the casing string 12 and the downhole completion tool 18, such that the third threshold pressure is greater than the pressure in the pressurized chamber. Accordingly, the third threshold pressure may be introduced to the pressurized chamber via the second port 98 and the annular cover flowpath 108 as illustrated in FIGS. 2G and 2H. In another embodiment illustrated in FIGS. 3G and 3H, the third threshold pressure may be introduced to the pressurized chamber via the first port 90, the casing flowpath 82, and the fluid passageway 97. In the embodiments illustrated in FIGS. 2G and 2H and FIGS. 3G and 3H, the corresponding pressure in the pressurized chamber allows for the application of a force against the first end portion 52 of the lower piston 48. The force produced by the applied third threshold pressure may be of sufficient magnitude to displace the lower piston 48, thereby shearing the shear screws 62 retaining the lower piston 48 in a fixed position. The force may axially displace the lower piston 48 in the downstream direction such that the lower piston 48 may contact or at least may be adjacent the second sub component 32. The force provided by the applied third threshold pressure may retain the lower piston 48 in contact with or adjacent the second sub component 32.

The displacement of the lower piston 48 in the downstream axial direction allows for the fluid communication of the flowbore 34 of the downhole completion tool 18 with the subterranean formation 20 or wellbore 10, or both, via the housing apertures 41. In the final position, stimulants and/or production fluid may flow therebetween via the housing apertures 41. Thus, the downhole completion tool 18 as described herein provides for the application of a pressure test and a subsequent fluid pathway for stimulation and/or production of the hydrocarbon well without the requirement of separate trips downhole.

In another embodiment, the casing string 12 may include a plurality of downhole completion tools 18 coupled with one another in series, commonly referred to as "daisy-chained." In another embodiment, the downhole completion tools 18 may be separated by portions of the casing string 12. By arranging the downhole completion tools 18 in series along a portion of the casing string 12, multiple pressure tests may be conducted before the production or stimulation of the well without further trips downhole. Thus, multiple pressure cycles may be provided in instances in which two or more pressure tests may be required.

Figure 4:
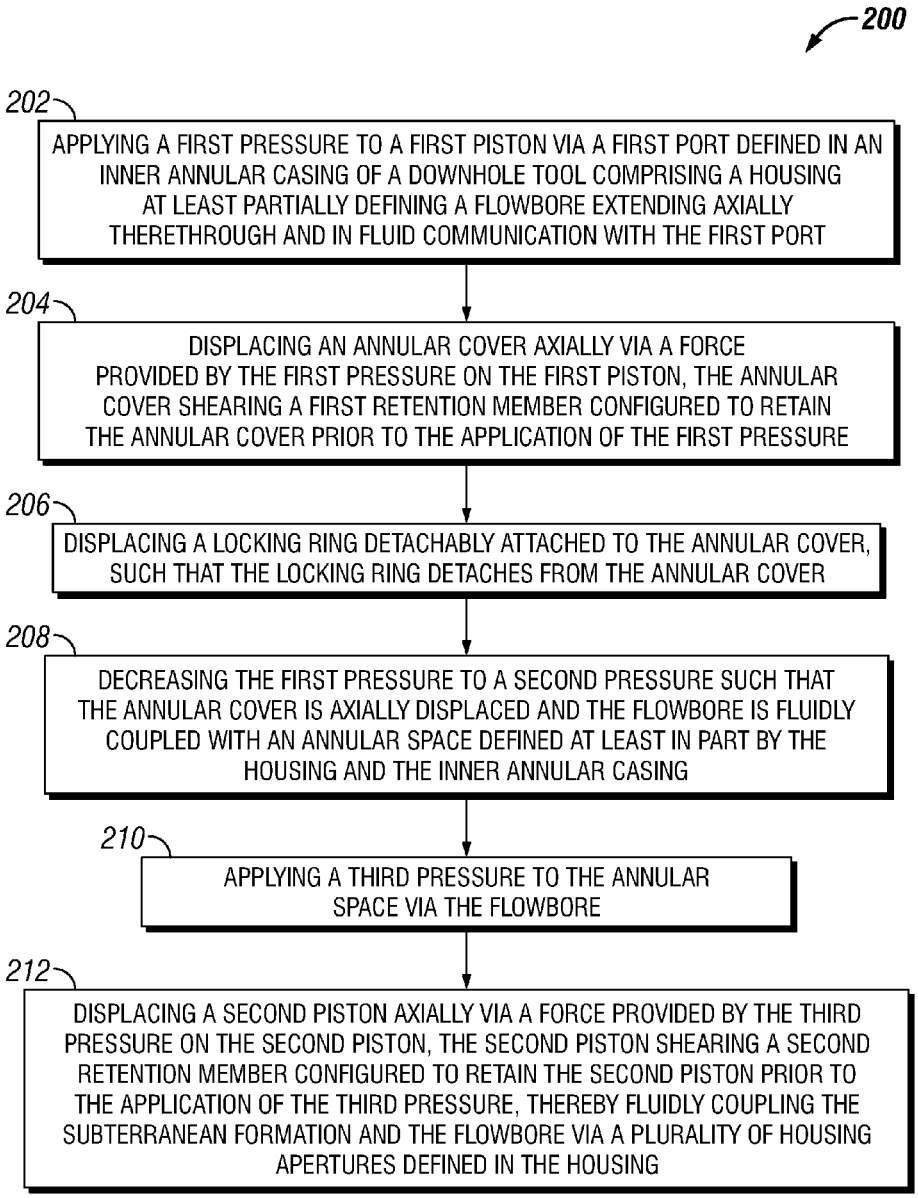
FIG. 4 is a flowchart illustrative of a method for servicing a subterranean formation, according to one or more embodiments disclosed.

As shown in FIG. 4, a method 200 for servicing a subterranean formation is provided, according to one or more embodiments of the present disclosure. The method 200 may include applying a first pressure to a first piston via a first port defined in an inner annular casing of a downhole tool including a housing at least partially defining a flowbore extending axially therethrough and in fluid communication with the first port, as at 202. The method 200 may also include displacing an annular cover axially via a force generated by the first pressure on the first piston, the annular cover shearing a first retention member configured to retain the annular cover prior to the application of the first pressure, as at 204. The method 200 may further include displacing a locking ring detachably attached to the annular cover, such that the locking ring detaches from the annular cover, as at 206.

The method 200 may also include decreasing the first pressure to a second pressure such that the annular cover is axially displaced and the flowbore is fluidly coupled with an annular space defined at least in part by the housing and the inner annular casing, as at 208. The method 200 may also further include applying a third pressure to the annular space via the flowbore, as at 210. The method may further include displacing a second piston axially via a force generated by the third pressure on the second piston, the second piston shearing a second retention member configured to retain the second piston prior to the application of the third pressure, thereby fluidly coupling the subterranean formation and the flowbore via a plurality of housing apertures defined in the housing, as at 212.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A downhole tool, comprising:

a housing at least partially defining a flowbore therethrough and a plurality of fluid apertures;

an inner annular casing disposed in the housing and defining in conjunction with the housing an annular space, the inner annular casing defining a casing flowpath and a first port configured to fluidly couple the flowbore and the casing flowpath;

an annular cover disposed in the annular space and configured to be displaced by a first piston at a first pressure applied to the flowbore and a biasing member at a second pressure applied to the flowbore;

an annular component being disposed in the annular space, the annular component and the annular cover defining a fluid passageway therebetween; and a second piston at least partially disposed in the annular space and configured to be displaced by a force provided by a third pressure applied to the annular space via the flowbore, such that the plurality of fluid apertures and the flowbore are fluidly coupled, wherein the downhole tool is configured such that at the second pressure applied to the flowbore, the biasing member is extended, such that the annular cover is displaced and the fluid passageway fluidly couples the annular space and the flowbore via the first port and the casing flowpath.

2. The downhole tool of claim 1, wherein:

the first piston is an upper piston disposed in the inner annular casing flowpath and the annular space and coupled with the annular cover; and the second piston is a lower piston slidingly engaged with the housing.

3. The downhole tool of claim 2, wherein the annular cover is detachably attached to a locking ring adjacent the biasing member.

4. The downhole tool of claim 3, further comprising:

a biasing nut disposed in the annular space, such that the biasing member is disposed between the annular cover and the biasing nut, wherein the annular component forms a shoulder and a lip at a recessed end portion, the shoulder being configured to seat the locking ring prior to the application of the first pressure to the flowbore and the lip being configured to seat the locking ring after the application of the first pressure to the flowbore.

5. The downhole tool of claim 4, wherein the downhole tool is further configured such that at the first pressure applied to the flowbore, the upper piston displaces the annular cover such that the locking ring detaches from the annular cover and the annular cover compresses the biasing member.

6. The downhole tool of claim 1, further comprising a plurality of seal components configured to retain the annular space at about atmospheric pressure as the first pressure is applied to the flowbore.

7. The downhole tool of claim 1, further comprising a plurality of retention members, the plurality of retention members comprising:

a first retention member configured to fixedly retain the annular cover prior to the application of the first pressure to the flowbore; and a second retention member configured to fixedly retain the second piston prior to the application of the third pressure to the flowbore.

8. A method of servicing a subterranean formation, comprising:

applying a first pressure to a first piston via a first port defined in an inner annular casing of a downhole tool comprising a housing at least partially defining a flowbore extending axially therethrough and in fluid communication with the first port;

displacing an annular cover axially via a force provided by the first pressure on the first piston, the annular cover shearing a first retention member configured to retain the annular cover prior to the application of the first pressure;

seating a locking ring, prior to the application of the first pressure, on a shoulder formed on an annular component disposed in an annular space defined at least in part by the housing and the inner annular casing, wherein the annular component and the annular cover define a fluid passageway therebetween and the inner annular casing further defines a casing flowpath;

displacing the locking ring detachably attached to the annular cover, such that the locking ring detaches from the annular cover;

decreasing the first pressure to a second pressure such that the annular cover is axially displaced and the flowbore is fluidly coupled with the annular space;

biasing the annular cover proximate the first port via a biasing member at the second pressure, wherein biasing the annular cover proximate the first port via the biasing member at the second pressure further comprises fluidly coupling the annular space and the flowbore via the first port and the casing flowpath;

applying a third pressure to the annular space via the flowbore; and displacing a second piston axially via a force provided by the third pressure on the second piston, the second piston shearing a second retention member configured to retain the second piston prior to the application of the third pressure, thereby fluidly coupling the subterranean formation and the flowbore via a plurality of housing apertures defined in the housing.

9. The method of claim 8, further comprising:

seating the locking ring, after the application of the first pressure, on a lip formed on the annular component.

10. The method of claim 8, further comprising disposing the downhole tool in a wellbore defined in the subterranean formation via a tubular member.

11. The method of claim 10, further comprising sealing the annular space prior to disposing the downhole tool in the wellbore, such that a fluid sealed in the annular space is at about atmospheric pressure.

12. The method of claim 10, wherein the second pressure is the hydrostatic pressure in the wellbore.

13. A downhole tool configured to be disposed in a wellbore defined in a subterranean formation, comprising:

a housing at least partially defining a flowbore therethrough and a plurality of fluid apertures;

an inner annular casing disposed in the housing and defining in conjunction with the housing an annular space, the inner annular casing further defining a casing flowpath and a first port configured to fluidly couple the flowbore and the casing flowpath;

an annular cover disposed in the annular space and configured to prevent fluid communication between the annular space and the flowbore during the application of a first pressure and to permit fluid communication between the annular space and the flowbore during the application of a second pressure and a third pressure;

an annular component disposed in the annular space, wherein the annular component and the annular cover define a fluid passageway therebetween, and the fluid passageway fluidly couples the flowbore and the annular space via the casing flowpath and the first port during the application of the second pressure and the third pressure;

a lower piston configured to engage the inner annular casing and prevent fluid communication between the flowbore and the wellbore via the plurality of fluid apertures at the application of the first pressure and the second pressure, the lower piston further configured to slidingly disengage with the inner annular casing and thereby permit fluid communication between the flowbore and the wellbore via the plurality of fluid apertures at the application of the third pressure;

an upper piston disposed in the casing flowpath and the annular space and configured to axially displace the annular cover at the application of the first pressure;

a biasing member configured to axially displace the upper piston and the annular cover to permit fluid communication between the annular space and the flowbore at the application of the second pressure; and a plurality of retention members, a first retention member of the plurality of retention members configured to retain the upper piston prior to the application of the first pressure and a second retention member of the plurality of retention members configured to retain the lower piston prior to the application of the third pressure.

14. The downhole tool of claim 13, further comprising:

a locking ring detachably attached to the annular cover, wherein the annular component forms a shoulder and a lip at a recessed end portion, the shoulder being configured to seat the locking ring prior to the application of the first pressure and the lip being configured to seat the locking ring after the application of the first pressure.

15. The downhole tool of claim 13, further comprising a biasing nut disposed in the annular space such that the biasing member positions the annular cover over the first port at the application of the second pressure and the third pressure.

* * * * *